US010519760B2

(12) United States Patent
Zaragoza Labes et al.

(10) Patent No.: US 10,519,760 B2
(45) Date of Patent: Dec. 31, 2019

(54) RECOVERABLE MODULE FOR SUBSEA ENVIRONMENTS AND USES THEREOF

(71) Applicant: FMC TECHNOLOGIES DO BRASIL LTDA, Rio de Janeiro (BR)

(72) Inventors: Alan Zaragoza Labes, Rio de Janeiro (BR); Ana Maria Guimarães Guerreiro, Rio de Janeiro (BR); Bernardo Ribeiro Ramos Da Costa, Niteroi (BR)

(73) Assignee: FMC TECHNOLOGIES DO BRASIL LTDA, Rio de Janeiro (BR)

( * ) Notice: Subject to any disclaimer, the term of this patent is extended or adjusted under 35 U.S.C. 154(b) by 119 days.

(21) Appl. No.: 15/539,222

(22) PCT Filed: Dec. 23, 2014

(86) PCT No.: PCT/BR2014/050055
§ 371 (c)(1),
(2) Date: Jun. 23, 2017

(87) PCT Pub. No.: WO2016/101047
PCT Pub. Date: Jun. 30, 2016

(65) Prior Publication Data

US 2017/0370201 A1 Dec. 28, 2017

(51) Int. Cl.
*E21B 43/38* (2006.01)
*B04C 5/28* (2006.01)
(Continued)

(52) U.S. Cl.
CPC ..... *E21B 43/38* (2013.01); *B04C 5/28* (2013.01); *E21B 43/36* (2013.01); *B04C 5/12* (2013.01); *B04C 5/14* (2013.01)

(58) Field of Classification Search
CPC . E21B 43/38; E21B 43/36; B04C 5/28; B04C 5/12; B04C 5/14; B01D 21/267; B01D 17/0217
See application file for complete search history.

(56) References Cited

U.S. PATENT DOCUMENTS 4,208,270 A * 6/1980 Grieve ..... B04C 5/28 165/82
5,336,410 A * 8/1994 O'Brien ..... B04C 5/08 209/728

(Continued)

FOREIGN PATENT DOCUMENTS

BR 8906964 A 12/1990
GB 2457012 A 8/2009

OTHER PUBLICATIONS

International Search Report issued in corresponding application No. PCT/BR2014/050055 dated Sep. 28, 2015 (2 pages).

(Continued)

*Primary Examiner* — David J Bagnell
*Assistant Examiner* — Yanick A Akaragwe
(74) *Attorney, Agent, or Firm* — Osha Liang LLP

(57) ABSTRACT

A recoverable module is configured for subsea environments, and is suitable for use in the processing of fluids linked to the oil industry, and subsea fluid separation equipment or equipment involving any process performed through liners. The recoverable module for subsea environments includes a separating vessel provided with an inlet and two underflow and overflow or tailing outlets, in addition to a cover which has a set of removable liners fastened to its interior.

18 Claims, 5 Drawing Sheets

(51) Int. Cl.

| | |
|---|---|
| ***E21B 43/36*** | (2006.01) |
| *B04C 5/12* | (2006.01) |
| *B04C 5/14* | (2006.01) |

(56) References Cited

U.S. PATENT DOCUMENTS

| | | | | |
|---|---|---|---|---|
| 5,965,022 | A | 10/1999 | Gould et al. | |
| 6,918,494 | B2 | 7/2005 | Girdler | |
| 2003/0222003 | A1 | 12/2003 | Girdler | |
| 2005/0103691 | A1* | 5/2005 | Hakola ..... | B01D 45/12 209/715 |
| 2011/0259819 | A1* | 10/2011 | Beedie ..... | B04C 5/08 210/512.1 |

OTHER PUBLICATIONS

Written Opinion of the International Searching Authority issued in corresponding application No. PCT/BR2014/050055 dated Sep. 28, 2015 (5 pages).

* cited by examiner

RECOVERABLE MODULE FOR SUBSEA ENVIRONMENTS AND USES THEREOF

FIELD OF THE INVENTION

The present invention relates to a recoverable module for subsea environments. The system which is object of the present invention is especially suitable for use mainly in fluids linked to the oil industry, and subsea fluid separation equipment or equipment involving any process performed through liners.

BACKGROUND OF THE INVENTION

The construction and mode of operation of hydrocyclones are well known in the industry. Initially, offshore platforms used to employ large separating vessels to treat separation water. The high cost to accommodate such systems encouraged the development of de-oiler hydrocyclones for the offshore oil industry in the 1980's, rapidly making them standard equipment for recovery of oil from production waters.

Hydrocyclones are equipment that separate liquid and/or particulate in mixtures or in suspension which may be based on the density of the liquids or the density of the particles, respectively. The hydrocyclone is usually comprised of a cylindrical section at the top comprising a tangential liquid inlet aperture and a conical base. The angle and the size of the conical section play an important role in the performance of the equipment. The module usually has two outputs in opposite positions: the overflow or tailing, whereby the less dense liquid is ejected and the underflow through which the higher density liquid is ejected under higher flow.

Internally, a centrifugal force produces a rapid acceleration of the fluids, causing the denser liquid to flow towards the walls and then through the underflow, and the less dense liquid to flow towards the outlet referred to as tailing. The diameter of the tailing outlet is 1.5 to 5 mm in diameter when the separator is of liquid/liquid type. One disadvantage of this type of system is that often, materials such as asphaltenes deposit and build up within the hydrocyclones, decreasing performance and often causing equipment clogging.

Hydrocyclones may be composed of hydrocyclone liners arranged within a vessel. In general, they are arranged in packages of dozens of liners (56, 72, . . . ), with the inlets and outlets common to liners, in communication with the underflow and overflow. Several systems involve a large number of liners employed in a complex pipe inlet and outlet system that communicate with a separation system plant, which takes up a lot of space and requires a high-cost support structure.

U.S. Pat. No. 6,918,494 shows an improvement in the arrangement of liner packages within the separator vessel to reduce space and allow accommodation of a greater number of liners. Such upgrading is of extreme importance for applications on offshore platforms and FPSOs where space is an important issue. The reduction of space occupied by a compact arrangement minimizes equipment costs and improves the flow of distribution to the liner inlets.

Currently, lighter crude oil resources are declining, leaving an increasing share of supply of increasingly heavier oils. Sources of heavy oil are still plentiful, with no more than 3% of the heavy oil discovered being currently produced. As a result, heavy oils are expected to play an increasingly important role in oil production.

Production separators are one of the most disturbed equipment due to instabilities in the flow of fluids from oil producing wells. The separators, besides promoting phase separation (water, oil and water), dampen production oscillations. On the other hand, load and space restrictions in offshore units require the equipment to be compact, which makes them more sensitive to the production oscillations.

Among the usual separation equipment, we have the hydrocyclones, designed to separate sand from the inlet fluid (de-sanders), de-waters, and/or de-oilers. Currently, in order to bypass the problems of fields that produce a lot of water and prevent this water from being treated on the platforms or topsides (FPSOs), subsea separation systems have been developed. However, such equipment requires maintenance and is installed in hostile and difficult to reach environments. This type of equipment suffers even more under the conditions of operation with heavy oils, which can lead to clogging of this equipment.

The purpose of this invention is to develop an oil/water separation system which alleviates problems related to maintenance and space in subsea equipment and which consists of desander, hydrocyclone and/or de-water modules. Thus, it will provide a novel and improved option for the treatment of mixtures, especially mixtures from the oil production process, such as heavy oils.

In view of the increased use of heavy oils in the oil producing industry, the present invention provides a recoverable subsea module which provides ease of intervention and/or equipment replacement. Such module may be applied to mix separation systems and may be extended to any apparatus which comprises a vessel containing hydrocyclones or liners grouped therein to carry out a process.

BRIEF DESCRIPTION OF THE DRAWINGS

The present invention will now be described with reference to the attached figures, which represent in a schematic non-limiting way.

DETAILED DESCRIPTION OF THE INVENTION

Figure 1:
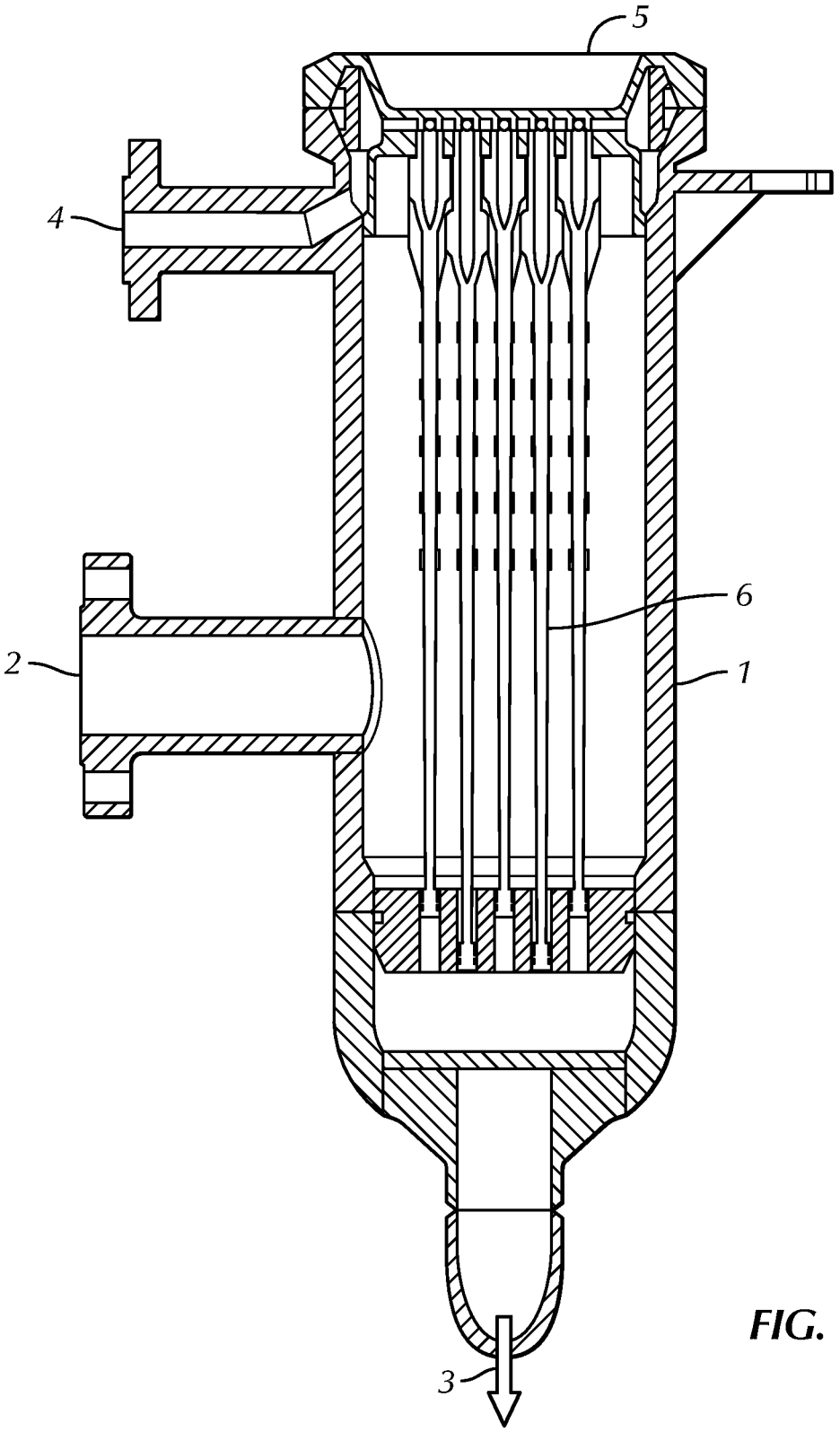
FIG. 1—longitudinal cross-sectional view of the recoverable module according to the present invention, FIG. 2—longitudinal cross-sectional view of the recoverable module according to the present invention illustrating the mobility of the set of liners.
Figure 2:
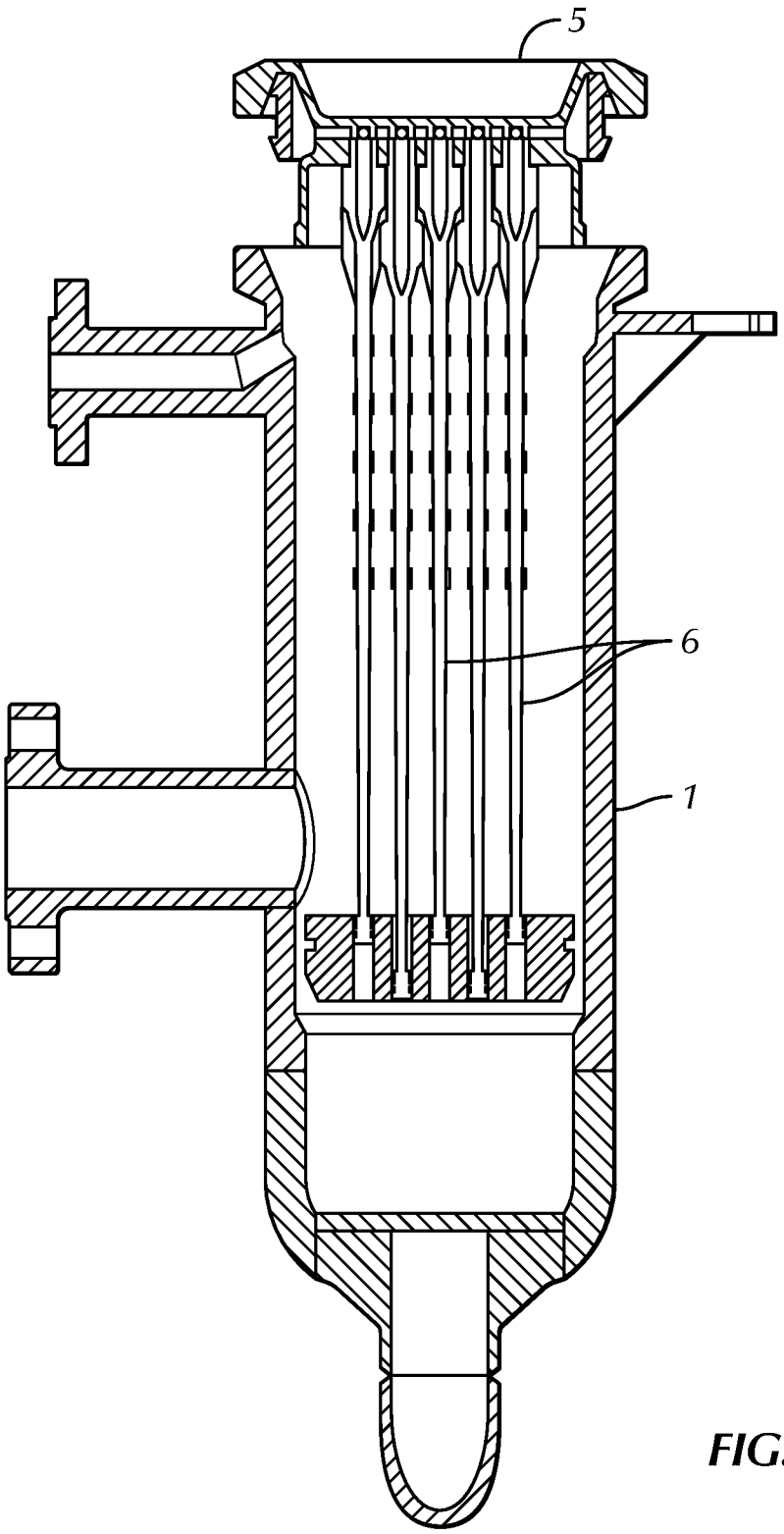

As shown schematically in FIG. 1, the present invention relates to a recoverable module for subsea environments consisting of a separating vessel (1) comprising an inlet (2) and two underflow (3) and overflow or tailing (4) outlets, in addition to a cover (5) for fastening, on the inside, a set of removable liners (6). FIG. 2 shows an illustrative detail of the cover 5 with the set of removable liners 6 being withdrawn from the equipment for possible maintenance and/or replacement.

Figure 3A:
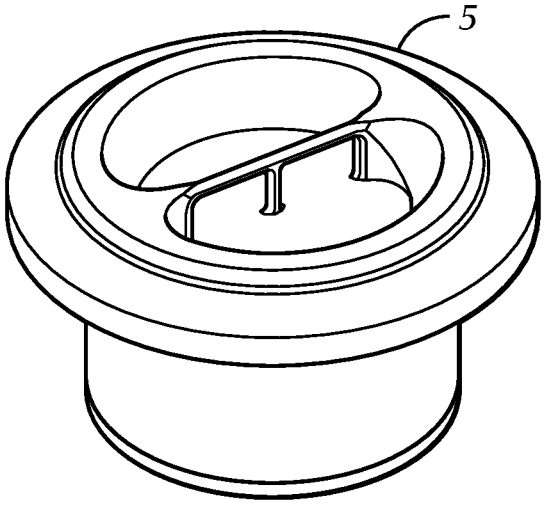
FIG. 3A is a perspective view of the cover of the recoverable module.
Figure 3B:
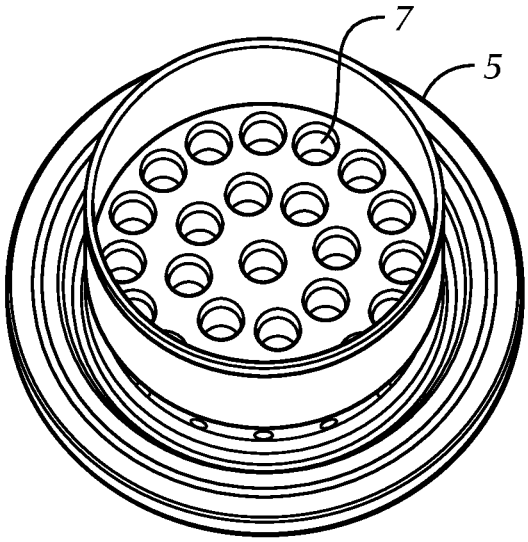
FIG. 3B is a bottom view of the module cover.
Figure 3C:
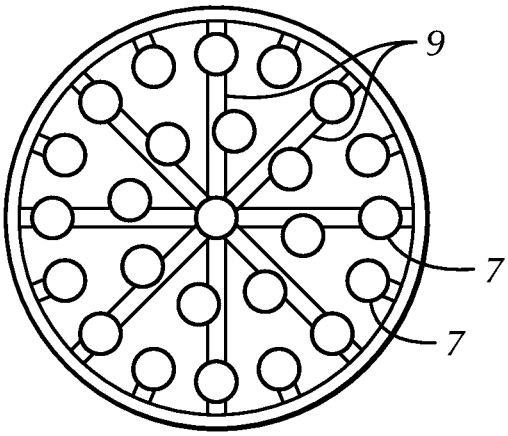
FIG. 3C shows bores for fluid (oil) passage.

The removable liners (6) are screwed into apertures (7) suitably provided in the inner part of the cover (5) (FIG. 3B), and are preferably arranged in pairs, i.e., sets of two. Thus, the internal space occupied by said removable liners (6) will be minimized, allowing allocation of more of these units if necessary. Moreover, the reduction of the space occupied by said removable liners (6) represents a great differential compared to existing equipment in the prior art for application in offshore platforms and FPSOs, since there is usually not much space available.

Fastening said removable liners (6) to the inside of the cover promotes the formation of an assembly that can be easily removed and/or exchanged as a whole (FIG. 2).

The facilitated handling of the removable set of liners (6) allows its maintenance and recovery to be performed by a Remotely Operated Vehicle (ROV). To date, this new procedure was not possible for commercially available subsea equipment in the prior art. This feature is extremely advantageous since said removable liners (6) are constantly a focus of obstruction, and the facilitation of their removal to be exchanged in case of issues of clogging is a solution that, up to this moment, cannot be found in existing equipment.

Another advantage provided by the ease of access to the removable set of liners (6) is the possibility of matching the material of said liners to the processed fluids if necessary. In the event of interference from the material, the assembly can be easily replaced and adapted to new needs.

Figure 4:
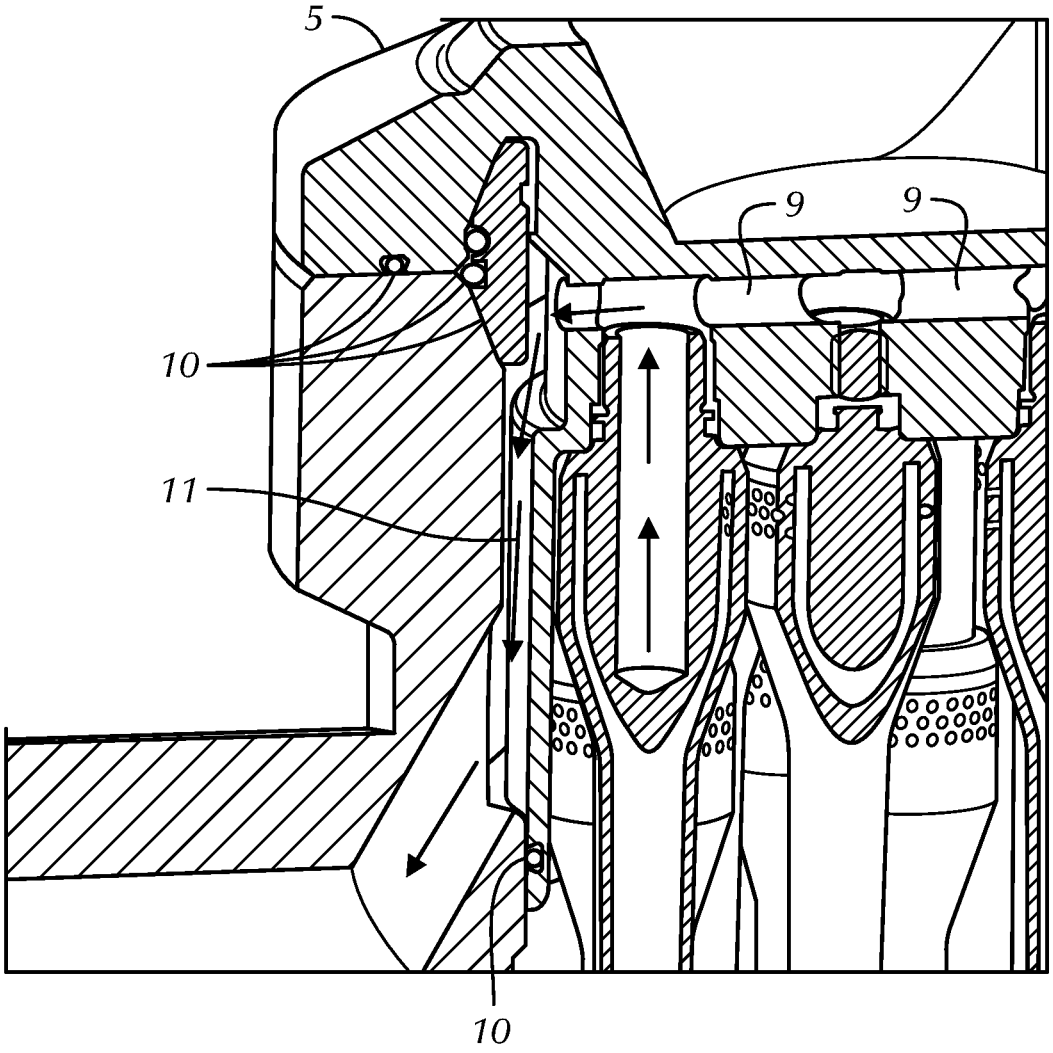
FIG. 4—longitudinal cross-sectional view of the top of the recoverable module according to the present invention, FIG. 5—perspective view of the lower part of the fastening disc module, and FIG. 6—longitudinal cross-sectional view of the bottom of the recoverable module according to the present invention.

In addition, the inner part of the cover (5) comprises a structure provided with tubular apertures (9) which provide for the interconnection between the tailings of said removable liners (6) in order to ensure maintenance of the overflow or tailing outlet flow (4). This design can be visualized in FIG. 4.

The cover can be produced in various non-corrosive materials, such as titanium. The advantage of using titanium is in reducing the final weight of the equipment when compared to other materials commonly used in subsea equipment. In total, the weight of the removable assembly composed of titanium may be, for example, less than 500 kg, preferably less than 150 kg. The reduction in the final weight of the equipment also contributes both to the reduction of the impact of the load on the offshore unit to which it is applied, and to the mobility of the equipment, facilitating any intervention through an ROV.

The use of the recoverable module according to the invention in an equipment which is in an subsea environment requires that sealing elements (10) be included to prevent contact of the fluid with the external medium and also to avoid possible mixing of the separated fluids, for example, in the flow path of the fluid (11) by the overflow (4). Various materials known and usually employed for sealing subsea equipment may be employed. Especially, O-rings and KX sealing rings may be used for metal/metal seals. Thus, the cover (5) will be closed and energize the sealing ring through, for example, a clamp.

The high level of disturbance and/or oscillation suffered by the separators, especially those treating heavy oils, requires the removable liners (6) to be further fastened to the lower part of the separation vessel (1). That is, in addition to being screwed into the cover (5) in the upper part of the separator vessel (1), said removable liners (6) are also fastened to the lower portion of the separator vessel (1). The fastening to the lower part prevents said removable liners (6) from unscrewing due to the shaking and vibration of the environment.

Figure 5:
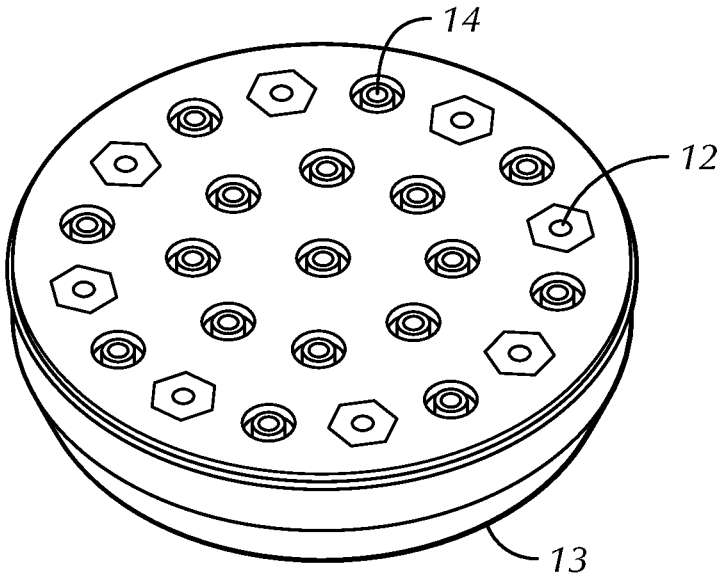
Figure 6:
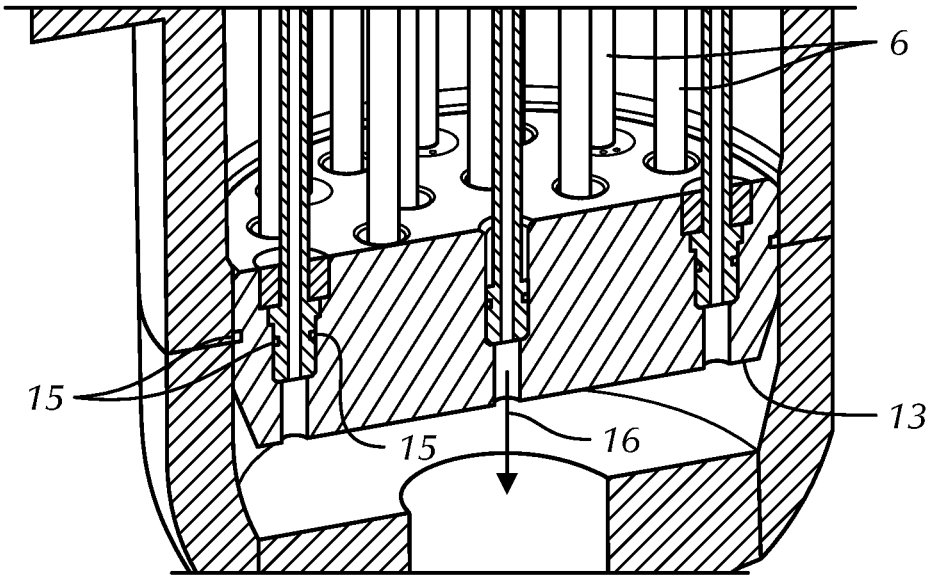

The lower fastening of the removable liners (6) may be accomplished by the engagement of hexagonal nuts (12) on a cylindrical disc-shaped body (13) comprising tubular holes (14) that prevent movement thereof. Further, sealing elements (15) prevent the flow of the overflow from mixing with the upper chamber. This arrangement may be well visualized in FIGS. 5 and 6. Thus, the cylindrical disc-shaped body (13), in addition to preventing the removable liners (6) from unscrewing, is also essential for separating the inlet fluid from the underflow outlet fluid (3).

The disc-shaped cylindrical body (13) may be produced from materials having low density and chemical resistance characteristics, and an elastomeric material is preferably suitable.

In this regard, the recoverable module for subsea environments which is the object of the present invention has been developed to be advantageously employed in subsea units by providing for easy handling of the liner assemblies and, consequently, providing easier maintenance and/or exchange of said assemblies. In addition, the recoverable module for subsea environments which is the object of the present invention may be advantageously applied in any process operating through liners and is not limited to the phase separation process of a mixture.

The invention claimed is:

1. A recoverable module for subsea environments, comprising:

a separating vessel, the separating vessel comprising an inlet, two underflow, overflow or tailing outlets, and a cover with a set of removable liners fastened to an interior of the cover thereby forming an assembly removable as a single unit from the separating vessel, wherein the cover provides a sealed, closed end of the separating vessel.

2. The recoverable module for subsea environments of claim 1, wherein the set of removable liners is fastened to the cover through apertures provided in the interior of the cover, and wherein the set of removable liners are screwed into the apertures.

3. The recoverable module for subsea environments of claim 2, wherein the set of removable liners are arranged on the cover in sets of two.

4. The recoverable module for subsea environments of claim 2, wherein said cover further comprises a structure provided with tubular apertures.

5. The recoverable module for subsea environments of claim 1, further comprising sealing elements.

6. The recoverable module for subsea environments of claim 5, wherein the sealing elements are O-rings and/or KX sealing rings.

7. The recoverable module for subsea environments of claim 1, further comprising a lower portion of the set of removable liners, wherein the lower portion of the removable liners are fastened to a cylindrical disc-shaped body comprising tubular apertures.

8. The recoverable module for subsea environments of claim 7, wherein said cylindrical disc-shaped body is constructed from materials having a low density and chemical resistance.

9. The recoverable module for subsea environments of claim 8, wherein said cylindrical disc-shaped body is produced from an elastomer.

10. The recoverable module for subsea environments of claim 7, wherein the set of removable liners are fastened to said cylindrical disc-shaped body by hexagonal nuts.

11. The recoverable module for subsea environments of claim 7, wherein said cylindrical disc-shaped body further comprises sealing elements.

12. The recoverable module for subsea environments of claim 1, wherein said cover is constructed from titanium.

13. The recoverable module for subsea environments of claim 1, wherein the recoverable module has a weight of no more than 500 kg.

14. The recoverable module for subsea environments of claim 13, wherein the recoverable module has a weight of not more than 150 kg.

15. The recoverable module for subsea environments of claim 1, wherein the separating vessel defines a hydrocyclone.

16. The recoverable module for subsea environments of claim 1, wherein the cover comprises a structure having apertures, the set of removable liners fastened to the cover through the apertures, and at least one transverse tubular aperture interconnected between at least two of the apertures.

17. The recoverable module for subsea environments of claim 16, wherein the at least one transverse tubular aperture is in fluid communication with at least two tailings of the removable liners and an overflow outlet of the separating vessel.

18. The recoverable module for subsea environments of claim 17, wherein the at least one transverse tubular aperture is axially positioned between the cover and the overflow outlet.

* * * * *